US007384304B1

(12) United States Patent
Fawcett

(10) Patent No.: US 7,384,304 B1
(45) Date of Patent: Jun. 10, 2008

(54) CABLE ATTACHMENT DEVICE

(75) Inventor: Christopher J. Fawcett, Charlotte, NC (US)

(73) Assignee: InVue Security Products Inc., Charlotte, NC (US)

( * ) Notice: Subject to any disclaimer, the term of this patent is extended or adjusted under 35 U.S.C. 154(b) by 0 days.

(21) Appl. No.: 11/640,614

(22) Filed: Dec. 18, 2006

(51) Int. Cl.
*H01R 13/60* (2006.01)

(52) U.S. Cl. ..... 439/567

(58) Field of Classification Search ..... 439/567, 439/367, 369, 373, 544, 135
See application file for complete search history.

(56) References Cited

U.S. PATENT DOCUMENTS 5,577,855 A 11/1996 Leyden et al.
5,928,023 A * 7/1999 Buckner et al. ..... 439/373
6,491,541 B2 12/2002 Wakino
6,494,735 B1 * 12/2002 Chen et al. ..... 439/378
6,802,723 B2 * 10/2004 Decime et al. ..... 439/135
6,902,432 B2 6/2005 Morikawa et al.

* cited by examiner

*Primary Examiner*—Alexander Gilman
(74) *Attorney, Agent, or Firm*—Sand & Sebolt

(57) ABSTRACT

A device for securing a cable plug within a socket of an apparatus such as a USB plug within the USB port of a computer. A housing having an interior chamber is placed over the plug by sliding the cord through an axial slot formed in the housing, with the plug cord extending through an end opening of the housing. A retainer clip or collar having a U-shaped channel formed about an inner end periphery is slid over and along the housing and mates with a complementary shaped channel formed in the housing to lock the clip and housing together. A pair of adhesive pads are mounted on the ends of the pair of arms extending outwardly from the retaining clip for attachment to the apparatus adjacent the plug receiving socket.

19 Claims, 4 Drawing Sheets

CABLE ATTACHMENT DEVICE

BACKGROUND OF THE INVENTION

1. Technical Field

The invention relates to a device for securing a cable, and in particular a cable plug within a receiving port of an apparatus. Even more particularly, the invention relates to such a device which secures a USB plug into a USB port of an electrical appliance or apparatus such as a computer, preventing the USB plug from being prematurely detached or unplugged from the apparatus, and in addition can be used to prevent unauthorized theft of the apparatus.

2. Background Information

Various types of electrical wires and cables are connected to numerous types of electronic equipment, appliances and apparatus, for supplying power and communications to and from the apparatus to and from a remote location. These cables terminate in a connector or plug which is plugged into a port or socket formed in the apparatus such as a computer, printer, camcorder or numerous other types of electronic appliances. Occasionally, these plugs will become partially or fully detached from the equipment during movement of the equipment or cable preventing loss of power or transmission between the equipment and a remote location causing aggravation to the user and possible damage to the cable or connected equipment.

In retail businesses, many types of electronic equipment such as computers, camcorders, gaming systems etc. are displayed on a shelf for inspection and use by a perspective customer. In order to enable the customer to fully appreciate the equipment, it is connected to a remote source such as the internet or electrical power supply, enabling the perspective customer to see and test the equipment for its intended use. One problem that occurs is that it exposes the equipment to possible theft from the retail establishment. Various devices have been used such as separate sensors attached to the equipment which will sound an alarm if the equipment is removed from the sensor or the equipment is removed from the store. Other types of security controls can be incorporated into the equipment by means of the USB port found on many such types of equipment.

Thus, a merchant can supply electric power, internet connection, security controls etc. to the various types of equipment via a USB plug and receiving socket or port provided on the equipment. Again, when used in such a fashion, it is desirable to firmly secure the plug in the USB port of the protected equipment in a manner preventing its accidental dislodgement from the equipment resulting in a premature alarm sounding in the store with the resultant problems, that such a premature alarm could cause. Several known types of devices have been developed for securing a USB cable or security cord or cable in a product such as shown in U.S. Pat. Nos. 5,577,855 and 6,491,541. Although these prior art devices for securement have proven satisfactory for certain installations, it is desirable that the means of securement or cable attachment device be of a simple, inexpensive construction, easily adaptable for use with various plug constructions, and which can be reused on various products. The cable attachment devices of the present invention achieve these results.

BRIEF SUMMARY OF THE INVENTION

One aspect of the present invention is to provide a cable attachment device formed of inexpensive plastic material which is adapted to entrap the plug end of the cable within a hollow interior of a housing which surrounds the plug and which is connected to the associated electrical equipment by pressure sensitive adhesive to reduce the possibility of a premature dislodgement of the plug from the receiving socket or port of the equipment.

Another feature is to form the housing of the attachment device with an elongated slot for slidably receiving the cord of the supply cable therethrough, afterwhich the housing is slid over the plug and secured thereto by a retaining clip which is slid over the housing and connected to the equipment by attachment means, such as a pair of pressure sensitive adhesive pads.

Another aspect of the invention is to enable the attachment device to be used with a cable plug whether it be a usual USB cable, a power supply cable, a security cable etc. which is attached to a remote alarm, power source, internet server etc.

Still another feature of the present invention is to mount a pair of adhesive attachment pads on the ends of flexible arms which extend outwardly from the plug housing retaining clip, which arms may have sufficient flexibility to adapt to various contours of the equipment adjacent the receiving port of the equipment.

These features and objectives are obtained by the attachment device of the present invention which is used for securing a conductor plug in a receiving socket of an apparatus, in which the general nature of the device comprises a housing having an interior chamber and formed with first and second ends with an opening formed in each end, and a slot extending along the housing between the end openings, and wherein the housing is adapted to receive and trap the plug within the interior chamber; a clip having an opening receives the first end of the housing therethrough; surfaces formed on the clip and housing cooperatively engage with each other to prevent movement of the clip beyond the second end of the housing; and an attachment member on the clip secures the clip and housing on the apparatus adjacent the socket for securing the conductor plug in the receiving socket.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
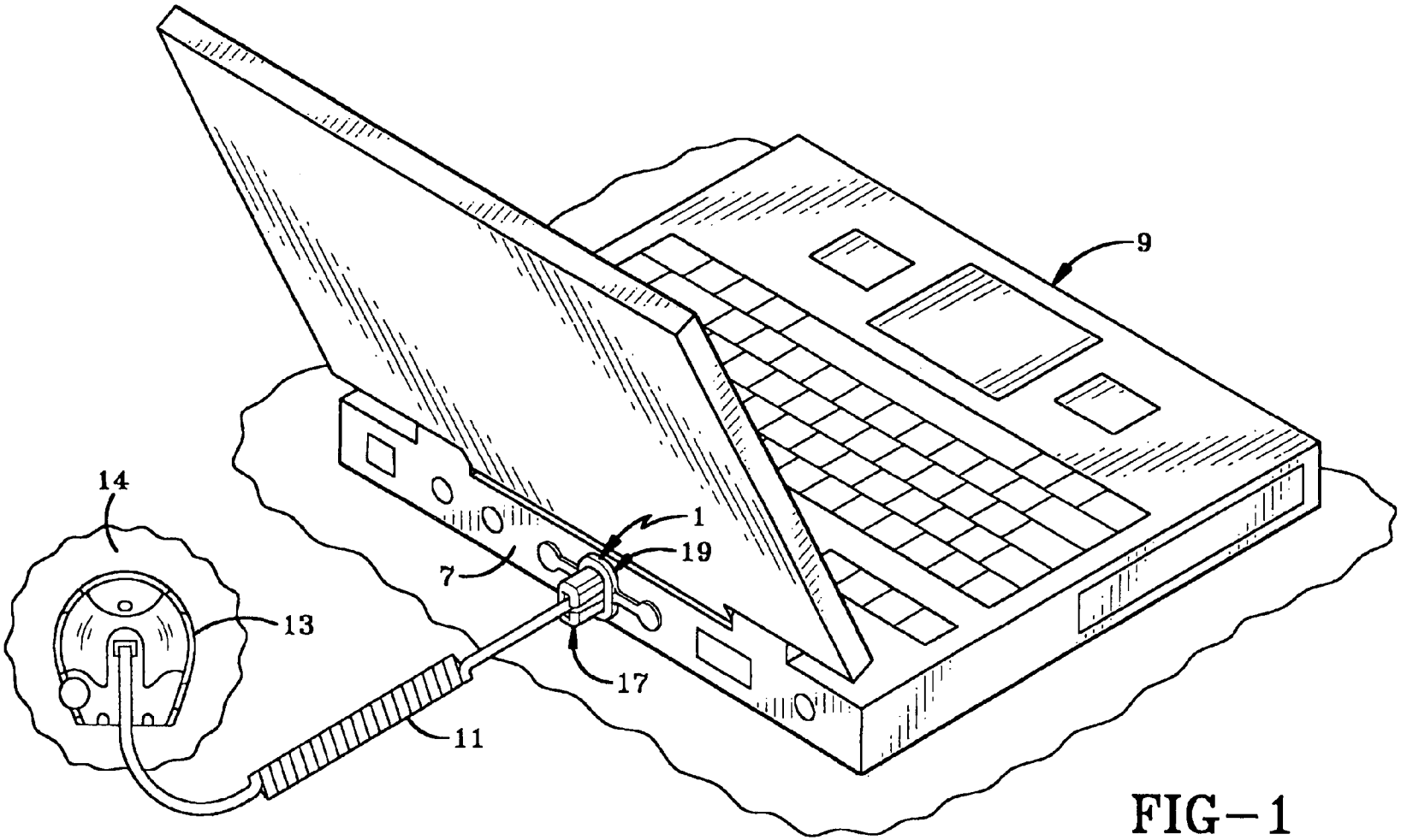
FIG. 1 is a perspective view of the cable attachment device of the present invention securing a cable plug within the receiving port of a computer.

The improved cable attachment device of the present invention is indicated generally at 1, and is shown in FIG. 1 securing a plug 3 in a receiving socket or port 5 formed in a rear wall 7 of a computer indicated generally at 9. Plug 3 is illustrated in FIG. 1 attached to a conductor cord 11, which in turn is connected to a remotely located device 13, such as a security alarm module mounted on a support structure 14 located within a retail establishment. This type of connection enables a customer to pick up and move computer 9 while the same remains attached to the alarm module 13, which will sound an alarm if cord 11 is severed or plug 3 removed from socket 5. Cord 11 can be connected to different outlets than alarm module 13, such as an internet service connection, a source of electric power etc. for supplying power or signals through the conductors of cord 11 to computer 9 without affecting the concept of the invention. Furthermore, it is readily understood that other types of electrical devices, equipment, appliances etc. having a receiving socket adapted to receive a cord plug can be used with attachment device 1 without departing from the concept of the invention. Computer 9 having a USB socket 5, and correspondingly a USB plug 3 as shown in the drawings is illustrative of only one type of equipment with which device 1 can be utilized.

Figure 2:
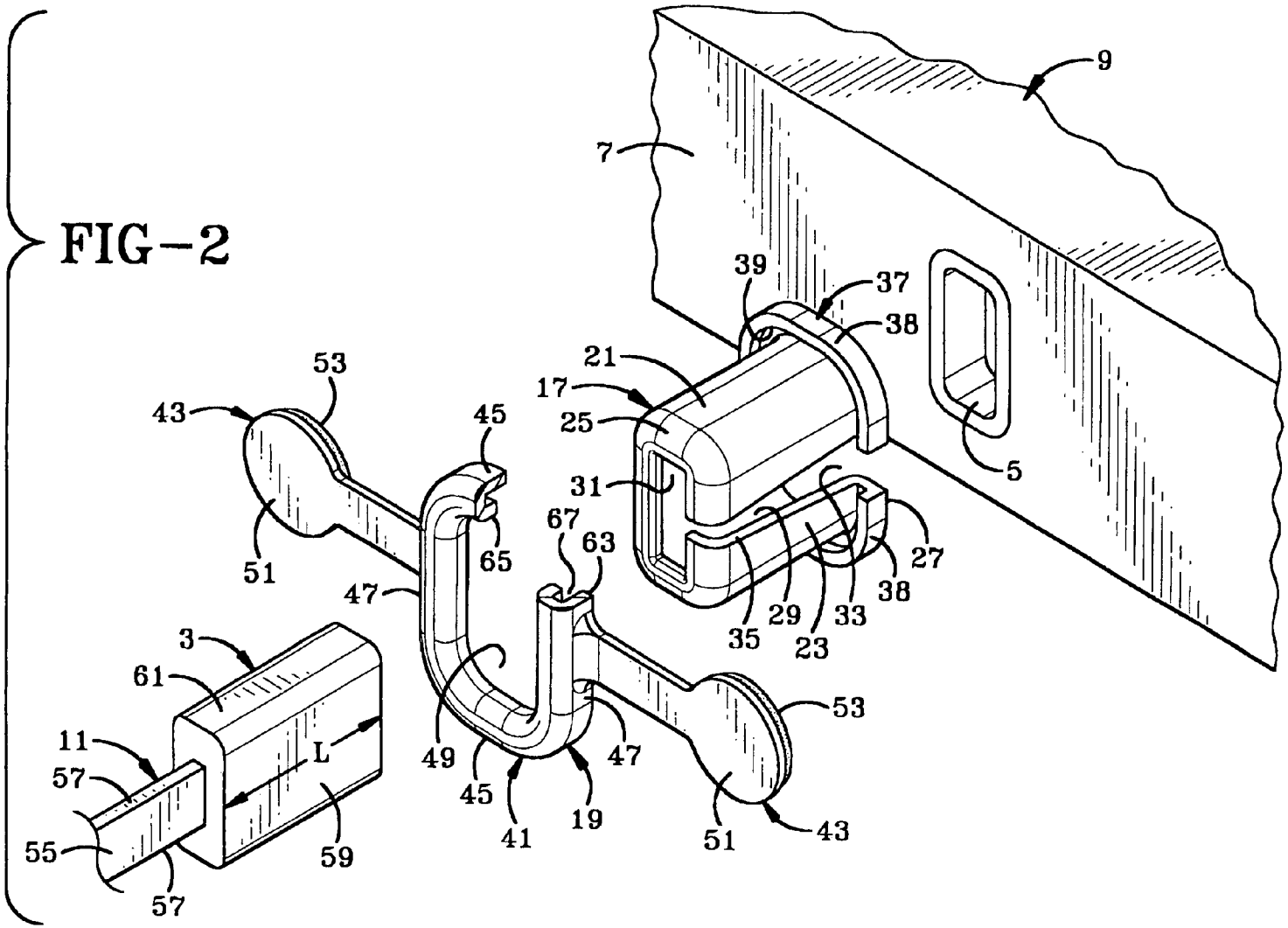
FIG. 2 is an exploded perspective view of the cable attachment device of the present invention with portions of the retaining clip broken away.

Device 1 is shown in an exploded perspective condition in FIG. 2 and includes two main components, a housing indicated generally at 17 and a retaining clip indicated generally at 19. Both housing 17 and retaining clip 19 preferably are one piece members formed of a plastic material enabling them to be easily formed in various shapes, sizes and colors. Housing 17 has a generally rectangular-shaped cross section and includes top and bottom walls 21, spaced opposed side walls 23, an outer end 25 and an inner end 27, all of which form a hollow interior 29 in which plug 3 is trapped as described further below. A pair of axially spaced openings 31 and 33 are formed in housing ends 25 and 27 respectively, and are connected by an axially extending slot 35 which extends between and communicates with end openings 31 and 33 and interior chamber 29. Outer end opening 31 will be smaller than inner end opening 33 to permit the passage of plug 3 through opening 33 but not through opening 31. A U-shaped collar 37 having a reverse flange 38 defines the periphery of inner end opening 33 of housing 17 and forms a channel 39 extending about the inner end of housing 17.

Retaining clip 19 includes a generally rectangular-shaped collar or body 41 and a pair of outwardly extending arms 43. Collar 41 includes a pair of spaced end walls 45 and a pair of spaced side walls 47, with arms 43 extending outwardly from side walls 47. Walls 45 and 47 form an opening 49 through which housing 17 is slidably inserted when attaching retaining clip 19 on housing 17 as described below. End walls 45 and side walls 47 are generally U-shaped forming a continuous channel 67 extending about the inside periphery of collar 41. Clip arms 43 terminate in disc-shaped ends 51 having a pressure sensitive adhesive pad 53 mounted on the inner sides thereof.

Figure 3:
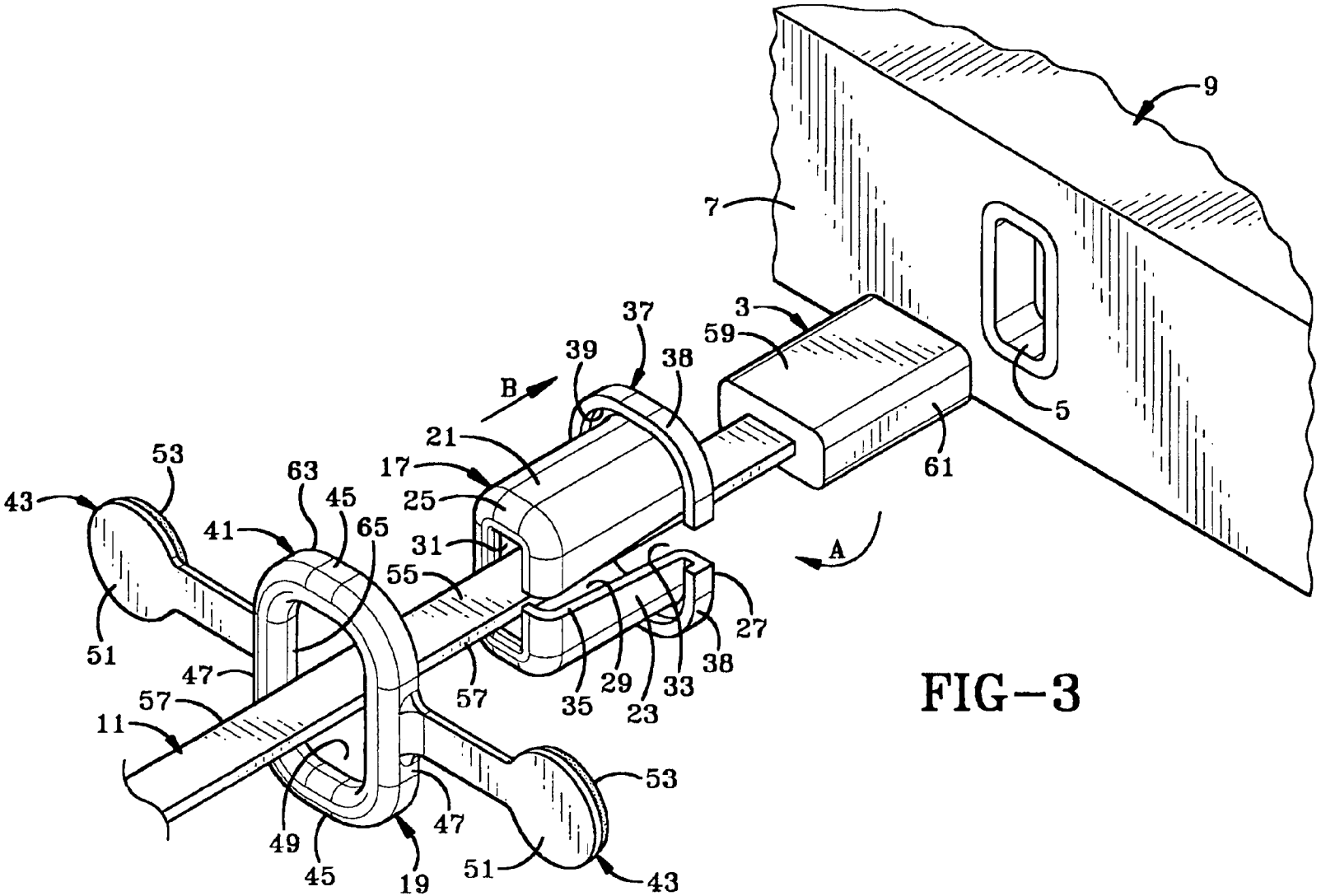
FIG. 3 is a perspective view showing the method of attaching the cable attachment device to a cable plug.
Figure 4:
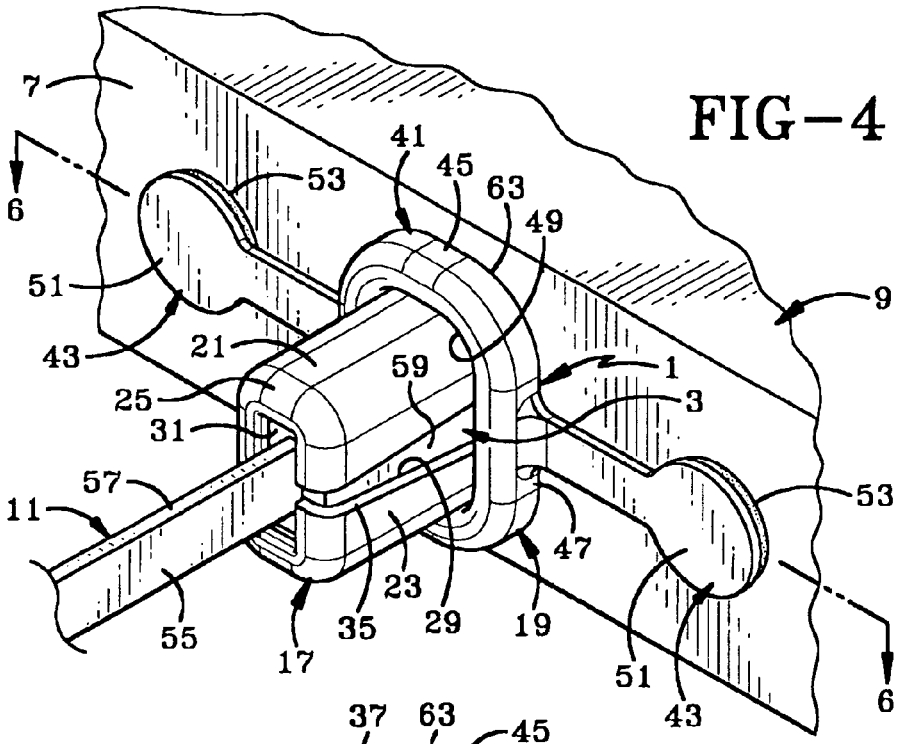
FIG. 4 is a fragmentary perspective view of the cable attachment device securing a plug to the receiving port of an apparatus.
Figure 5:
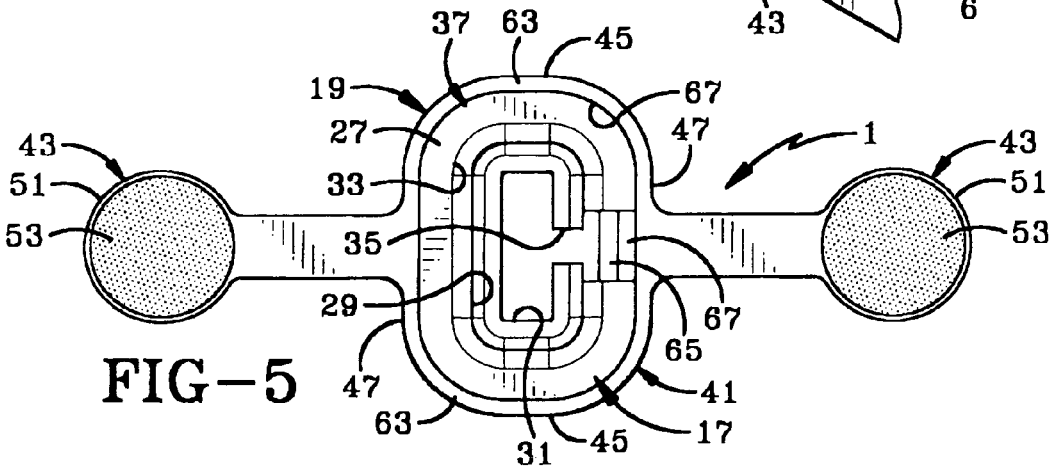
FIG. 5 is a rear elevational view of the cable attachment device in an assembled position with the plug being removed.
Figure 6:
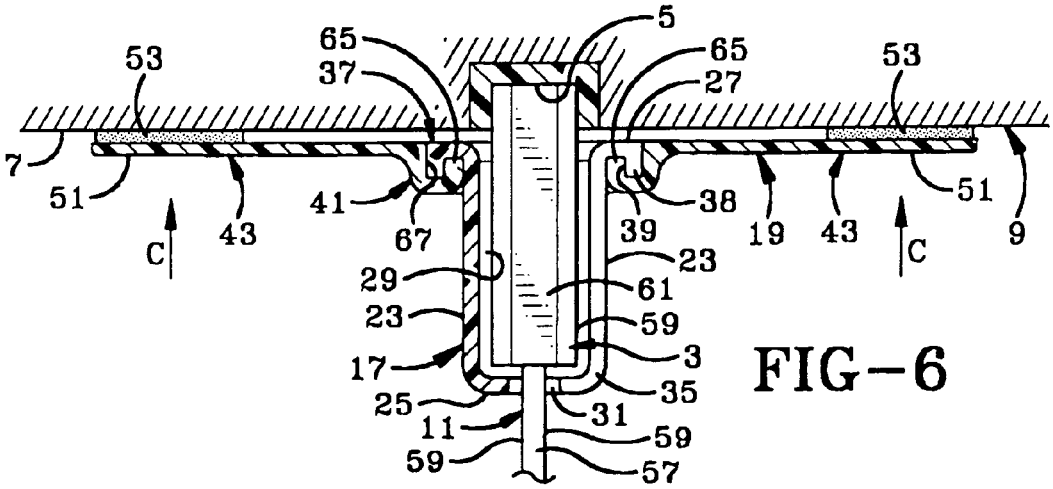
FIG. 6 is a sectional view taken on line 6-6, FIG. 4.

The operation and assembly of cable attachment device 1 is best shown in FIG. 3. Conductor cord 11 which for many types of electronic apparatus such as computer 9, will be a ribbon-type of cord, that is, one having a generally flat rectangular-shape as opposed to a round conductor as used in many types of electronic and electrically connected apparatus. As shown in FIG. 3, cord 11 will have opposed longitudinal flat sides 55 and smaller connecting edges or sides 57. Opening 49 of retaining clip 19 is large enough to permit conductor plug 3 to be inserted therethrough, afterwhich housing 17 is placed about conductor 11 by sliding the smaller dimension of the cord, that is side 57, through slot 35 and into the interior 29 of the housing. As shown in FIG. 3, after inserting cord 11 through slot 35, the cord is rotated 90° as shown by Arrow A, placing it in the position as shown FIGS. 1 and 5. Housing 17 is then moved along cord 11 as shown by Arrow B, until it traps plug 3 in hollow interior 29 as shown in FIGS. 4 and 6. In this position, the rectangular configuration of plug 3 will generally correspond to the internal rectangular shape of housing 17. Housing 17 is sized so that the interior surfaces of side walls 23 and end walls 21 correspond generally with the flat side walls 59 and end walls 61 of plug 3. Retaining clip 19 then is slidably moved along housing 17 until the outer peripheral edge portion 63, which together with upturned flange 65 forms U-shaped channel 67, engages the upturned end 38 of U-shaped collar 37 as shown in FIG. 6, to interlock clip 19 with housing 17 preventing housing 17 from moving outwardly away from wall 7 of computer 9.

Protective sheets (not shown) usually are provided over adhesive pads 53, are removed enabling the adhesive pads to be pressed against wall 7 to secure device 1 on the computer as shown in FIG. 4, trapping and retaining plug 3 in its connected position within socket 5 as shown in FIG. 6. This additional security prevents plug 3 from inadvertently and accidentally being removed from socket 5 even as the attached equipment such as computer 9, is moved and inspected by a perspective purchaser. If desired, cable 11 can be provided with appropriate conductors which connect with alarm circuitry in alarm module 13 to sound an alarm if plug 3 is removed from socket 5 or if cable 11 is severed.

It is readily understood that device 1 can be used with computer 9 as shown in the drawings or with other types of electrical appliances and equipment to retain a power cable or other type of cable to the appliance, whether the appliance is used in a home or other non-retail location, without affecting the concept of the invention. Again, the important feature is that device 1 provides a relatively simple and inexpensive device which is readily attached to a piece of equipment or apparatus for securing a plug into a socket without requiring any modification to the socket or plug, and which can be removed easily from the apparatus to permit the plug to be removed from the socket and subsequently reapplied to the same or different plug. Furthermore, housing 17 can accommodate various sizes and configurations of the plug so long as the plug has at least one dimension which does not permit the plug from passing through outer end opening 31, since housing 17 need not fit tightly about the plug in order to prevent the plug from being removed from the socket. Furthermore, the axial length of housing 17 is chosen with respect to the axial length L of plug 3 to prevent the plug from moving outwardly from socket 5 a sufficient distance to disconnect from the internal wiring of computer 9 before contacting outer end 25 of housing 17. Thus, this enables the housing to be sized for accommodating different sized plugs. Likewise, cable 11 can have other configurations, such as square, round etc. so long as it will pass through slot 35, which due to the molding of housing 17 of plastic, provides some flexibility thereto enabling the size of slot 35 to be slightly increased by pulling outwardly on the adjacent walls which form slot 35, enabling a cord to be inserted into interior 29 through the slot prior to securing clip 19 about housing 17 by the mutual engagement of clip flange 65 with housing flange 38 as shown in FIG. 6.

Likewise, after several uses of device 1 adhesive pads 53 can easily be replaced with new adhesive pads enabling the device to be used repeatedly without replacing either of the main components, namely housing 17 and retaining clip 19. Furthermore, clip arms 43 preferably are relatively thin flat planar members which provide some flexibility thereto enabling the arms to more closely correspond with and match the surface to which it is attached which surrounds socket 5, in the event that the surfaces are not perfectly flat as shown by walls 7 in the drawings. This would enable device 1 to be attached to an apparatus in which the walls would be curved or depressed adjacent socket 5 without affecting the results achieved by device 1.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A device for securing a conductor plug in a receiving socket of an apparatus comprising:

a housing having an interior chamber, said housing being formed with first and second ends with an opening formed in each of said ends and a slot extending along the housing between said end openings, said housing adapted to receive and trap the plug within the interior chamber;

a clip having a peripheral edge and an opening for receiving the first end of the housing therethrough;

engagement surfaces formed on the clip and housing which cooperatively engage each other to prevent movement of the clip beyond the second end of the housing, said engagement surfaces includes a U-shaped collar at the second end of the housing forming a channel with the peripheral edge of the clip being seated in the channel; and an attachment member on the clip for securing the clip and housing on the apparatus adjacent the socket for securing the conductor plug in the socket.

2. The device defined in claim 1 wherein the first end opening of the housing is smaller than the second end opening.

3. The device defined in claim 1 wherein the first end opening of the housing has a substantially rectangular shape; and in which the housing slot has a width smaller than a longer side of the rectangular opening.

4. The device defined in claim 1 wherein the housing has a generally rectangular cross-sectional shape; and in which the clip opening has a generally rectangular shape complementary to the housing for slidably moving the clip along the exterior of the housing.

5. The device defined in claim 1 wherein the clip includes a body and a pair of arms extending outwardly from the body; and in which the attachment member is a pair of adhesive pads mounted on the arms.

6. The device defined in claim 5 wherein the adhesive pads are disc-shaped pressure sensitive adhesive pads.

7. The device defined in claim 5 wherein the clip body has a generally rectangular shape with a pair of opposed end walls and a pair of opposed side walls; and in which the arms extend outwardly in opposite directions from the opposed side walls.

8. The device defined in claim 5 wherein the arms are elongated flat strips terminating in disc-shaped ends on which the adhesive pads are attached.

9. In combination, a connector and a device for securing the connector in a port of an apparatus; said connector comprising a connector plug and a cord extending outwardly from the plug; said device comprising:

a housing having an interior chamber formed with first and second ends with an opening formed in each of said ends and a slot extending between said end openings, said housing receiving and trapping the plug within the interior chamber;

a clip having a peripheral edge and an opening for slidably inserting the first end of the housing therethrough;

engagement surfaces formed on the clip and housing and cooperatively engaged to prevent movement of the clip beyond the second end of the housing, said engagement surfaces includes a U-shaped collar at the second end of the housing forming a channel with the peripheral edge of the clip being seated in the channel; and an attachment member on the clip for securing the clip and housing on an apparatus adjacent the socket for securing the conductor plug in the socket.

10. The combination defined in claim 9 wherein the apparatus is a computer and the port is a USB port in said computer.

11. The combination defined in claim 9 wherein the housing has a generally rectangular cross-sectional shape; and in which the clip opening has a generally rectangular shape complementary to the housing for slidably receiving the housing within the clip.

12. The combination defined in claim 9 wherein the clip includes a body and a pair of arms extending outwardly from the body; and in which the attachment member is a pair of adhesive pads mounted on the arms.

13. The combination defined in claim 12 wherein the clip body has a generally rectangular shape with a pair of opposed end walls and a pair of opposed side walls; and in which the arms extend outwardly in opposite directions from the opposed side walls.

14. The combination defined in claim 12 wherein the arms are elongated flexible flat strips terminating in disc-shaped ends on which the adhesive pads are attached.

15. A method for securing a plug of a conductive cord within a receiving socket of an apparatus comprising the step of:

providing a housing having a hollow interior, a pair of end openings connected by a slot, and an outwardly projecting flange;

placing the conductor plug in the interior of the plug by a) inserting the cord through the slot and then b) sliding the housing over the plug;

placing a retaining clip about the housing by telescopically inserting the housing through a clip opening;

inserting the plug into the receiving socket of the apparatus;

clamping the housing against the apparatus by:

a) telescopically sliding the clip along the housing; and b) cooperatively engaging a peripheral edge of the clip with the housing flange; and securing the clip to the apparatus adjacent the receiving socket to secure the plug in the receiving socket.

16. The method defined in claim 15 including the step of trapping the housing within the clip by inserting a peripheral edge of the clip within a channel formed in an end of the housing.

17. The method defined in claim 15 including the step of rotating the cord after inserting the cord through the housing slot before the step of sliding the housing over the plug.

18. The method defined in claim 15 including the steps of providing the clip with pressure sensitive adhesive and pressing said adhesive against the apparatus to secure the clip on the apparatus and maintain the housing clamped against the apparatus.

19. In combination, a connector and a device for securing the connector in a port of an apparatus; said connector comprising a connector plug and a cord extending outwardly from the plug; said device comprising:

a housing having an interior chamber and first and second open ends and a slot extending between said open ends, and a peripheral flange extending outwardly from the adjacent the second open end of the housing, said housing receiving and trapping the plug within the interior chamber;

a clip having an opening for slidably inserting the first end of the housing therethrough and a peripheral edge which cooperatively engages the peripheral flange of the housing for clamping the housing against the apparatus; and an attachment member on the clip for securing the clip on the apparatus and the housing clamped against the apparatus adjacent the socket for securing the conductor plug in the socket.

* * * * *